US007779504B2

(12) United States Patent
Lee et al.

(10) Patent No.: US 7,779,504 B2
(45) **Date of Patent: *Aug. 24, 2010**

(54) CLEANER SYSTEM

(75) Inventors: Jun Hwa Lee, Anyang-Si (KR); Jae Man Joo, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 229 days.

This patent is subject to a terminal disclaimer.

(21) Appl. No.: 11/501,081

(22) Filed: Aug. 9, 2006

(65) Prior Publication Data

US 2007/0157415 A1 Jul. 12, 2007

(30) Foreign Application Priority Data

Jan. 6, 2006 (KR) ..... 10-2006-0001921

(51) Int. Cl.
*A47L 9/28* (2006.01)
*A47L 7/00* (2006.01)
*A47L 5/12* (2006.01)

(52) U.S. Cl. ..... 15/319; 15/328

(58) Field of Classification Search ..... 15/319, 15/340.1, 340.2, 328; 700/245
See application file for complete search history.

(56) References Cited

U.S. PATENT DOCUMENTS 5,787,545 A * 8/1998 Colens ..... 15/319
6,076,226 A * 6/2000 Reed ..... 15/319
7,053,578 B2 * 5/2006 Diehl et al. ..... 318/568.12
7,055,210 B2 * 6/2006 Keppler et al. ..... 15/319
2005/0150519 A1 7/2005 Keppler et al.
2007/0157420 A1 * 7/2007 Lee et al. ..... 15/328

FOREIGN PATENT DOCUMENTS

| | | |
|---|---|---|
| DE | 197 53 668 | 11/1998 |
| ES | 2 238 196 | 8/2005 |
| JP | 7-47007 | 5/1995 |
| JP | 10-272078 | 10/1998 |
| JP | 2003-180587 | 7/2003 |

OTHER PUBLICATIONS

European Search Report for corresponding European application 06118999.9-2316, mailed Jul. 7, 2008.
Chinese Office Action for corresponding Chinese Application 200610129147.6; mailed Nov. 28, 2008.
Korean Search Report for corresponding Korean Application 2006-245755; dated Dec. 19, 2008.

* cited by examiner

*Primary Examiner*—David B Thomas
(74) *Attorney, Agent, or Firm*—Staas & Halsey LLP

(57) ABSTRACT

A cleaner system having an improved connecting position and structure between a robot cleaner and a docking station for achieving an improvement in dust removal performance of the docking station. The docking station performs manual cleaning. The robot cleaner has a dust outlet at a top wall of the robot body to discharge the dust collected in the first dust collector into the docking station, and the docking station has a connection port at a position thereof corresponding to the dust outlet to receive the dust discharged from the dust outlet. The robot cleaner or docking station includes a connector to connect the dust outlet to the connection port. The docking station includes a suction part, suction pipe, and suction hole for manual operation. A channel switching member is mounted in the docking station to selectively apply power required to suck dust to the connection port or suction hole.

16 Claims, 7 Drawing Sheets

CLEANER SYSTEM

CROSS-REFERENCE TO RELATED APPLICATIONS

This application claims the benefit of Korean Patent Application No. 10-2006-0001921, filed on Jan. 6, 2006 in the Korean Intellectual Property Office, the disclosure of which is incorporated herein by reference.

BACKGROUND OF THE INVENTION

1. Field of the Invention

The present invention relates to a cleaner. More particularly, to a cleaner system having a docking station, which is provided to suck and remove dust and loose debris stored in a robot cleaner.

2. Description of the Related Art

A conventional cleaner is a device used to remove dust in a room for cleaning the room. A conventional vacuum cleaner collects dust and loose debris by a suction force generated from a low-pressure unit. Recently, a cleaning robot, which is designed to remove dust and loose debris from the floor while moving on the floor via without manual operation, has been developed. Hereinafter, a term "automatic cleaning" refers to a cleaning operation performed by a robot cleaner that removes dust and loose debris while moving by itself, whereas a term "manual cleaning" refers to a cleaning operation performed by a person using a vacuum cleaner.

Generally, the robot cleaner is combined with a station (hereinafter, referred to as a docking station) to form a single cleaning system. The docking station is located at a specific place in a room and serves to charge the robot cleaner and to remove dust and debris stored in the robot cleaner.

One example of the above-described cleaner system is disclosed in U.S. Patent Publication No. 2005/0150519. The disclosed cleaner system includes a mobile suction appliance (i.e. robot cleaner) and a suction station having a suction unit to suck dust and loose debris. The robot cleaner includes a suction inlet at a bottom wall thereof, to suck dust and loose debris, and brushes are rotatably mounted in the proximity of the suction inlet, to sweep up the dust and loose debris. The suction station includes an oblique front surface to enable the robot cleaner to ascend therealong, and a suction inlet formed at a portion of the oblique front surface. Accordingly, when the robot cleaner ascends along the oblique front surface to reach a docking position, the suction inlet of the oblique front surface faces the suction inlet of the robot cleaner. In accordance with the operation of the suction unit, thereby, dust and debris, stored in the robot cleaner, are sucked into and removed by the suction station.

In the conventional cleaner system as stated above, the dust and debris, collected in the robot cleaner, are discharged through the suction inlet. However, the suction inlet, which is also used to suck dust and loose debris, has a broad width in order to efficiently suck the dust and loose debris, and therefore, is difficult to achieve an effective utilization of a suction force generated by the suction station.

Further, when the dust and loose debris are sucked from the robot cleaner into the suction station, the dust and debris, discharged from the suction inlet, tend to be caught by the brushes that are mounted in the proximity of the suction inlet of the robot cleaner. The dust and debris, caught by the brushes, may make the floor of a room unclean when the robot cleaner again performs automatic cleaning.

Furthermore, the conventional cleaner system has a problem in that a suction channel for connecting the suction inlet of the robot cleaner to the suction unit of the suction station must be located below the robot cleaner when the robot cleaner docks with the suction station, and therefore, the oblique front surface of the suction station must have a high height. This makes it difficult for the robot cleaner to dock with the suction station.

SUMMARY OF THE INVENTION

Accordingly, an aspect of the present invention is to provide a cleaner system having an improved connecting position and structure between a robot cleaner and a docking station, thereby achieving an improvement in dust removal performance of the docking station.

It is another aspect of the present invention to provide a cleaner system which allows a user to perform manual cleaning by use of a docking station, which serves to remove dust and debris collected in a robot cleaner.

Additional aspects and/or advantages of the invention will be set forth in part in the description which follows and, in part, will be apparent from the description, or may be learned by practice of the invention.

The foregoing and/or other aspects of the present invention are achieved by providing a cleaner system including a robot cleaner and a docking station, the robot cleaner including a robot body having an inlet to receive dust, and a first dust collector mounted in the robot body to collect the dust received, the docking station to remove the dust collected in the first dust collector when it is connected to the robot cleaner, wherein the robot cleaner includes a dust outlet at a top wall of the robot body to discharge the dust collected in the first dust collector into the docking station, and wherein the docking station includes a connection port formed at a position thereof corresponding to the dust outlet to receive the dust discharged from the dust outlet.

The cleaner system further includes a connector mounted in the robot cleaner or docking station to connect the dust outlet to the connection port when the robot cleaner is coupled to the docking station.

The dust outlet includes an opening/closing member to close the dust outlet when the robot cleaner performs automatic cleaning.

The robot cleaner further includes a rechargeable battery, and the docking station further includes a charger to be electrically connected to the rechargeable battery when the robot cleaner is coupled to the docking station, to charge the rechargeable battery.

The docking station further includes a station body, and a blower and a second dust collector which are mounted in the station body to suck and collect dust.

The docking station further includes a suction pipe, which is connected with the station body to enable manual cleaning using the docking station, and the station body includes a suction hole to communicate with the suction pipe.

A first suction channel is defined between the suction hole and the connection port, and a second suction channel is defined between the first suction channel and the second dust collector to communicate with the first suction channel.

Depending on a position where the first suction channel communicates with the second suction channel, the first suction channel is divided into a first channel portion in the proximity of the suction hole and a second channel portion in the proximity of the connection port, and the first suction channel includes a channel switching member to selectively communicate the second suction channel with one of the first and second channel portions.

The channel switching member is vertically movable in the first suction channel.

The channel switching member includes a first connection channel to connect the first channel portion to the second suction channel when the channel switching member moves downward, and a second connection channel to connect the second channel portion to the second suction channel when the channel switching member moves upward.

It is another aspect of the present invention to provide a cleaner system including a robot cleaner having a first dust collector, and a docking station to remove dust collected in the first dust collector, wherein the robot cleaner includes a dust outlet to discharge the dust into the docking station, and wherein the docking station includes a station body including a connection port to receive the dust discharged from the dust outlet; a suction hole to introduce dust sucked from the floor into the station body, a second dust collector to collect the dust delivered from the connection port and the suction hole, a blower to generate a suction force required for the suction of dust, and a channel switching member provided in the station body to selectively apply the suction force generated by the blower to the connection port or suction hole.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
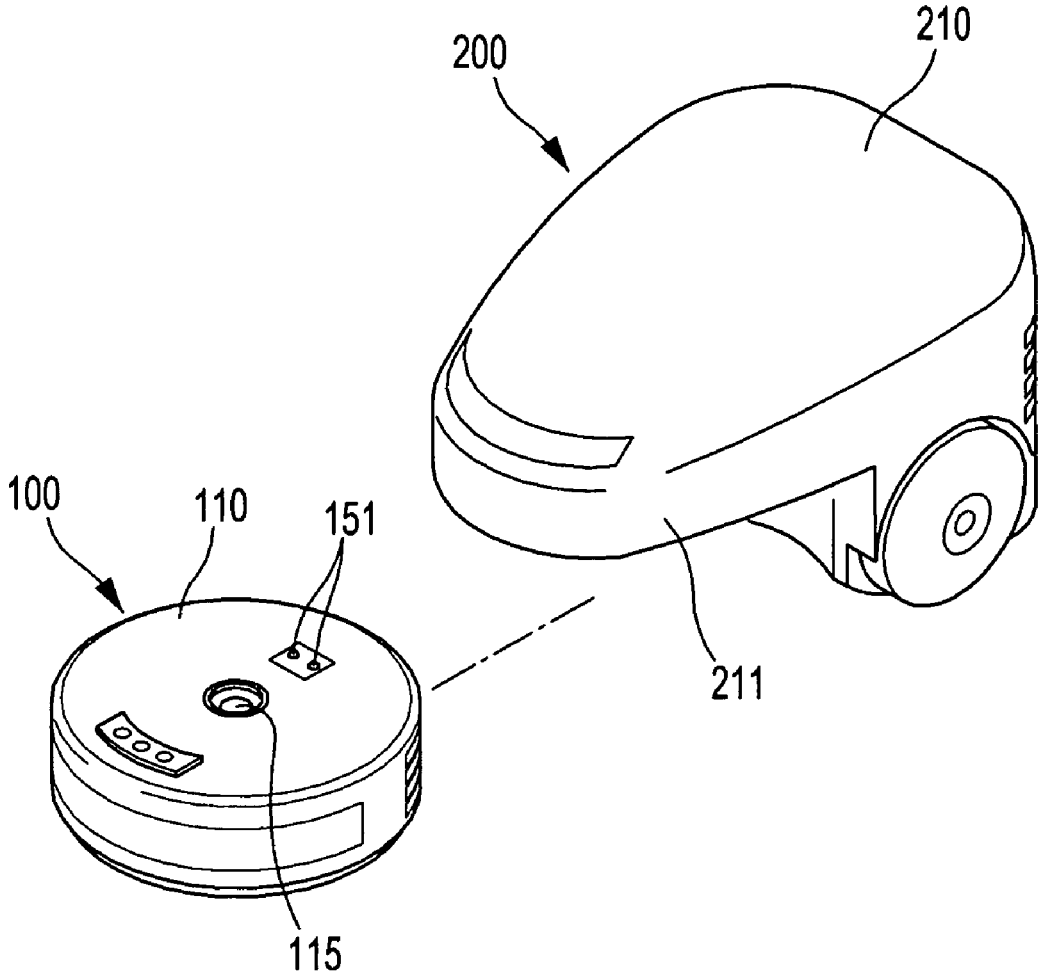
FIG. 1 is a perspective view illustrating an outer appearance of a cleaner system according to an embodiment of the present invention.

Reference will now be made in detail to the embodiment of the present invention, examples of which are illustrated in the accompanying drawings, wherein like reference numerals refer to like elements throughout. The embodiments are described below to explain the present invention by referring to the figures.

Figure 2:
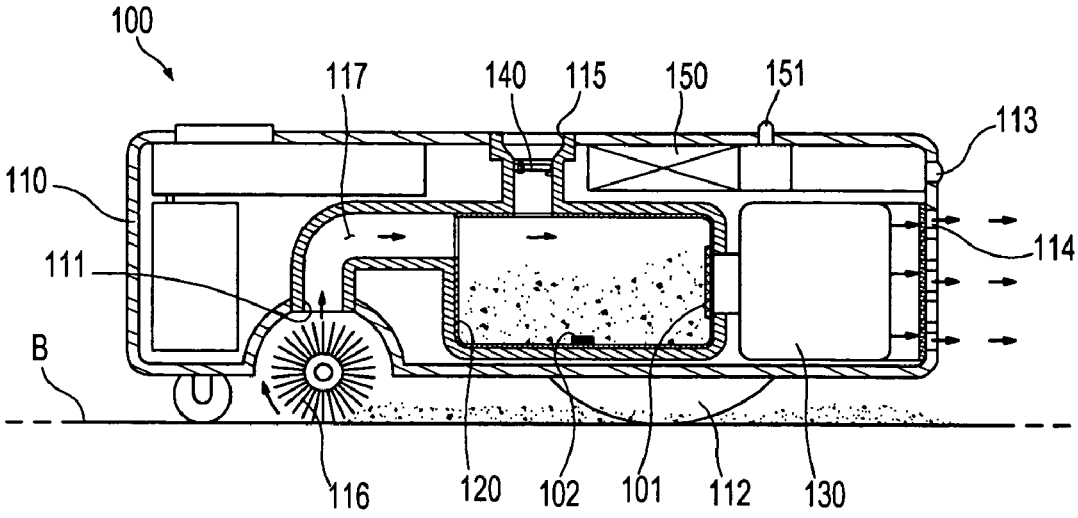
FIGS. 2 and 3 are side sectional views illustrating a robot cleaner and docking station as shown in FIG. 1, respectively.
Figure 3:
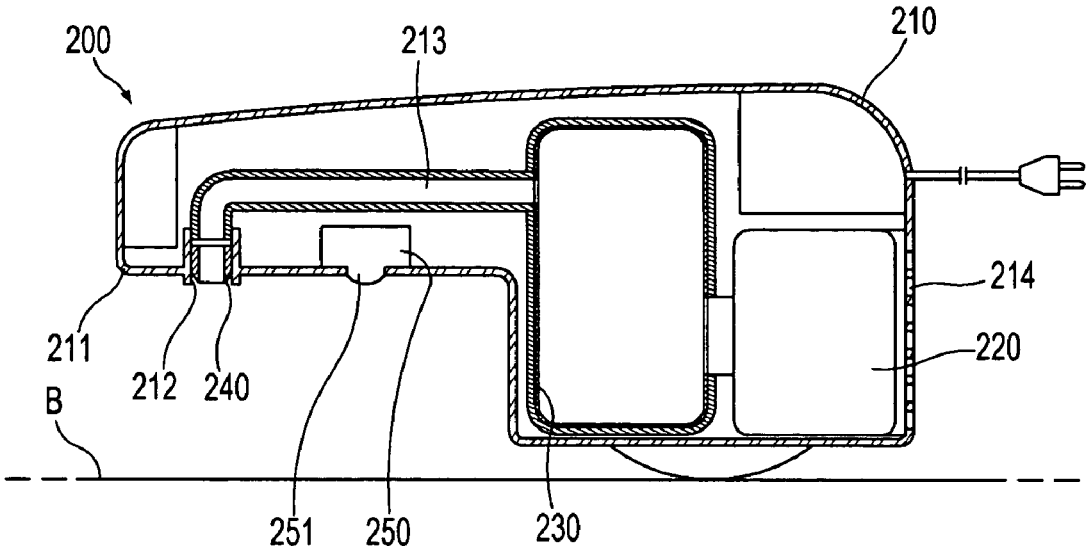
Figure 4:
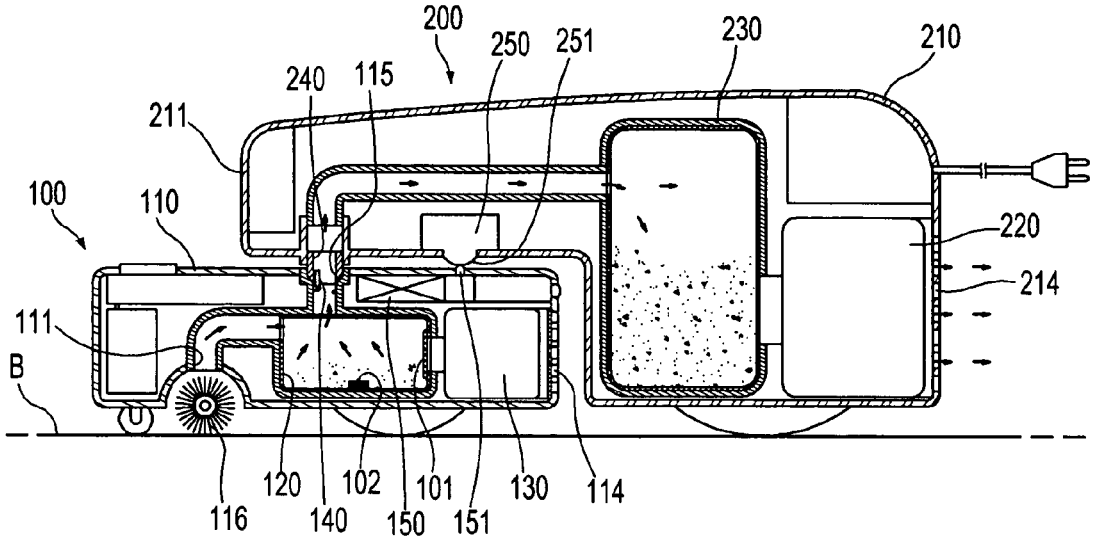
FIG. 4 is a side sectional view of the cleaner system of FIG. 1, illustrating the robot cleaner and docking station coupled to each other.

FIG. 1 is a perspective view illustrating an outer appearance of a cleaner system according to an embodiment of the present invention. FIGS. 2 and 3 are side sectional views illustrating a robot cleaner and docking station as shown in FIG. 1, respectively. FIG. 4 is a side sectional view of the cleaner system of FIG. 1, illustrating the robot cleaner and docking station coupled to each other.

As shown in FIGS. 1-4, the cleaner system according to an embodiment of the present invention, comprises a robot cleaner 100, and a docking station 200. The robot cleaner 100 includes a robot body 110 having an inlet 111 to receive dust and loose debris, and a first dust collector 120 mounted in the robot body 110 to collect the dust and debris received. The docking station 200 removes the dust and debris collected in the first dust collector 120 when it is connected with the robot cleaner 100. Specifically, the robot cleaner 100 is designed to perform automatic cleaning while moving by itself in an area to be cleaned. When the dust and debris sucked exceeds a predetermined level, the robot cleaner 100 returns to the docking station 200 for the removal of the dust and debris sucked.

As shown in FIG. 2, the robot cleaner 100 further includes a first blower 130 mounted in the robot body 110 to provide power required to suck dust and loose debris, and a filter 101 interposed between the first blower 130 and the first dust collector 120 to prevent the dust and debris sucked from entering the first blower 130. Although not shown, the first blower 130 has a suction motor and a fan to be rotated by the suction motor. Also, a dust quantity sensor 102 is mounted in the robot body 110 to sense the quantity of dust and debris collected in the first dust collector 120 and to determine whether the dust collected exceeds the predetermined level.

The robot body 110 comprises a pair of drive wheels 112 at a bottom wall thereof for the traveling of the robot cleaner 100. Each of the drive wheels 112 is selectively driven by a drive motor (not shown), to enable the robot cleaner 100 to move in a desired direction. The robot body 110 is also provided at an outer surface thereof with an obstacle detection sensor 113, such as an infrared sensor or ultrasonic sensor. The obstacle detection sensor 113 serves to measure distances between the robot cleaner 100 and obstacles located around the robot cleaner 100, so as to prevent the robot cleaner 100 from colliding with the obstacles.

In addition to the inlet 111 that is formed at the bottom wall of the robot body 110 to suck dust and loose debris from the floor B of the area to be cleaned, the robot cleaner 100 further comprises a first outlet 114 to discharge an air stream generated by the first blower 130 to the outside of the robot body 110, and a dust outlet 115 to discharge the dust and debris sucked into the docking station 200 when the robot cleaner 100 is coupled to the docking station 200. In the present embodiment, the first outlet 114 is formed at a rear wall of the robot body 110, and the dust outlet 115 is formed at a top wall of the robot body 110.

A brush 116 is rotatably mounted in the proximity of the inlet 111 of the robot body 110 to sweep up dust and loose debris from the floor B, and an inlet pipe 117 is interposed between the inlet 111 and the first dust collector 120 for connecting them to each other.

In the present invention, the dust outlet 115 being formed at the top wall of the robot body 110 as stated above, ensures a more efficient removal of the dust and debris collected in the first dust collector 120 as compared with a conventional configuration wherein dust and debris must be discharged through a dust inlet formed at a robot body. Also, there is no risk that the dust and debris, collected in the first dust collector 120, are caught by the brush 116 or fall on the floor B when they are discharged from the first dust collector 120.

The dust outlet 115 communicates with both the inlet pipe 117 and the first dust collector 120. An opening/closing member 140 is provided at the dust outlet 115 of the robot cleaner 100 to open the dust outlet 115 only when the robot cleaner 100 is coupled to the docking station 200. Specifically, when the robot cleaner 100 performs automatic cleaning, the opening/closing member 140 closes the dust outlet 115 to prevent a suction force generated by the first blower 130 from leaking through the dust outlet 115. Also, when the robot cleaner 100 is coupled with the docking station 200 for the removal of the dust and debris collected in the first dust collector 120, the opening/closing member 140 opens the dust outlet 115 to guide the dust and debris collected in the first dust collector 120 to the docking station 200.

The robot cleaner 100 further comprises a rechargeable battery 150 to supply electric power required for the operation of the robot cleaner 100. The rechargeable battery 150 is connected with a charging terminal 151, which protrudes upward out of the robot body 110 to be charged by a commercial alternator when the robot cleaner 100 is connected with the docking station 200.

As shown in FIG. 3, the docking station 200 comprises a station body 210, a second blower 220 mounted in the station body 210 to provide power required to suck the dust and debris collected in the first dust collector 120, and a second dust collector 230 mounted in the station body 210 to collect the dust and debris sucked. Although not shown, the second blower 220 includes a suction motor and a fan to be rotated by the suction motor.

The station body 210 comprises a protruding portion 211, which protrudes forward to cover a top of the robot cleaner 100 when the robot cleaner 100 returns to the docking station 200. The protruding portion 211 is formed with a connection port 212 at a position of a lower surface thereof corresponding to the dust outlet 115 when the robot cleaner 100 is coupled to the docking station 200. The connection port 212 receives the dust and debris delivered from the robot cleaner 100.

A connector 240 is fitted into the connection port 212 to connect the dust outlet 115 of the robot cleaner 100 to the connection port 212 when the robot cleaner 100 is coupled with the docking station 200. The connector 240 may be one selected from among a variety of elements to communicate the connection port 212 with the dust outlet 115 when the robot cleaner 100 is coupled with the docking station 200. In the present embodiment, the connector 240 is a movable tube mounted in the station body 210 in a vertically movable manner. Specifically, when the robot cleaner 100 is coupled with the docking station 200, the movable tube partially protrudes downward out of the station body 210 to communicate the connection port 212 with the dust outlet 115 (See FIGS. 3 and 4, for example). Alternatively, the connector 240 may be mounted in the robot cleaner 100.

A channel 213 is defined between the connection port 212 and the second dust collector 230 to guide the dust and debris, delivered through the connection port 212 from the first dust collector 120, to the second dust collector 230. Also, a second outlet 214 is formed at a rear wall of the station body 210 to discharge an air stream, generated by the second blower 220, to the outside of the station body 210.

A charger 250 is mounted in the station body 210 to charge the rechargeable battery 150 of the robot cleaner 100. A power terminal 251 is provided at a side of the charger 250 to be electrically connected with the charging terminal 151 when the robot cleaner 100 is coupled to the docking station 200.

Hereinafter, the operation of the cleaner system of the present invention will be explained with reference to FIGS. 1-4, for example. First, the robot cleaner 100 begins to move by itself to suck and remove dust and loose debris from the floor B of an area to be cleaned. In such a dust suction stage, the opening/closing member 140 of the robot cleaner 100 closes the dust outlet 115 to prevent a suction force generated by the first blower 130 from leaking through the dust outlet 115. Thereby, the dust and debris sucked from the floor B are collected in the first dust collector 120 by passing through the inlet 111 and the inlet pipe 117. When the quantity of dust and debris collected in the first dust collector 120 exceeds a predetermined level, the robot cleaner 100 ceases the cleaning, and returns to the docking station 200 for the removal of the dust and debris collected. When the robot cleaner 100 returns to a predetermined position, the connector 240 mounted in the docking station 200 communicates the dust outlet 115 of the robot cleaner 100 with the connection port 212 of the docking station 200. After completion of the above connecting procedure, the second blower 220 operates to deliver the dust and debris collected in the first dust collector 120 to the second dust collector 230 by suction, to empty the first dust collector 120. In this case, the inlet 111 and the first outlet 114 of the robot cleaner 100 are affected by an inward suction force, and therefore, there is no risk that the dust and debris collected leak out of the robot cleaner 100 through the inlet 111 when the dust and debris are delivered into the second dust collector 230. The inward suction force, also, has the effect of removing the dust and debris, clinging to the filter 101 in front of the first blower 130, to be delivered into the second dust collector 230.

Meanwhile, when the rechargeable battery 150 needs to be charged even if the robot cleaner 100 is not filled with dust and debris, the robot cleaner 100 ceases the cleaning, and returns to the docking station 200. In this case, if any dust and debris are collected in the first dust collector 120, they can be manually removed. Specifically, when a user inputs a dust removal command to the cleaner system during the charging of the robot cleaner 100, the connector 240 of the docking station 200 operates to communicate the dust outlet 115 of the robot cleaner 100 with the connection port 212 of the docking station 200, and successively, the second blower 220 operates to remove the dust and debris collected in the first dust collector 120.

Figure 5:
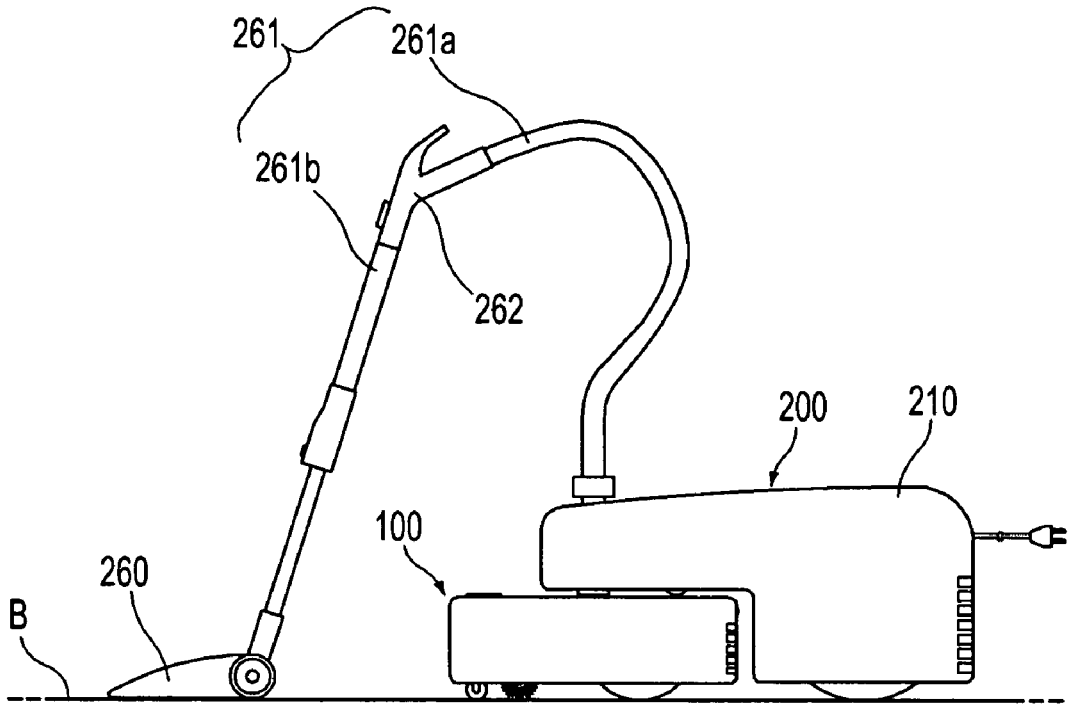
FIG. 5 is a perspective view schematically illustrating the outer appearance of a cleaner system according to another embodiment of the present invention.
Figure 6:
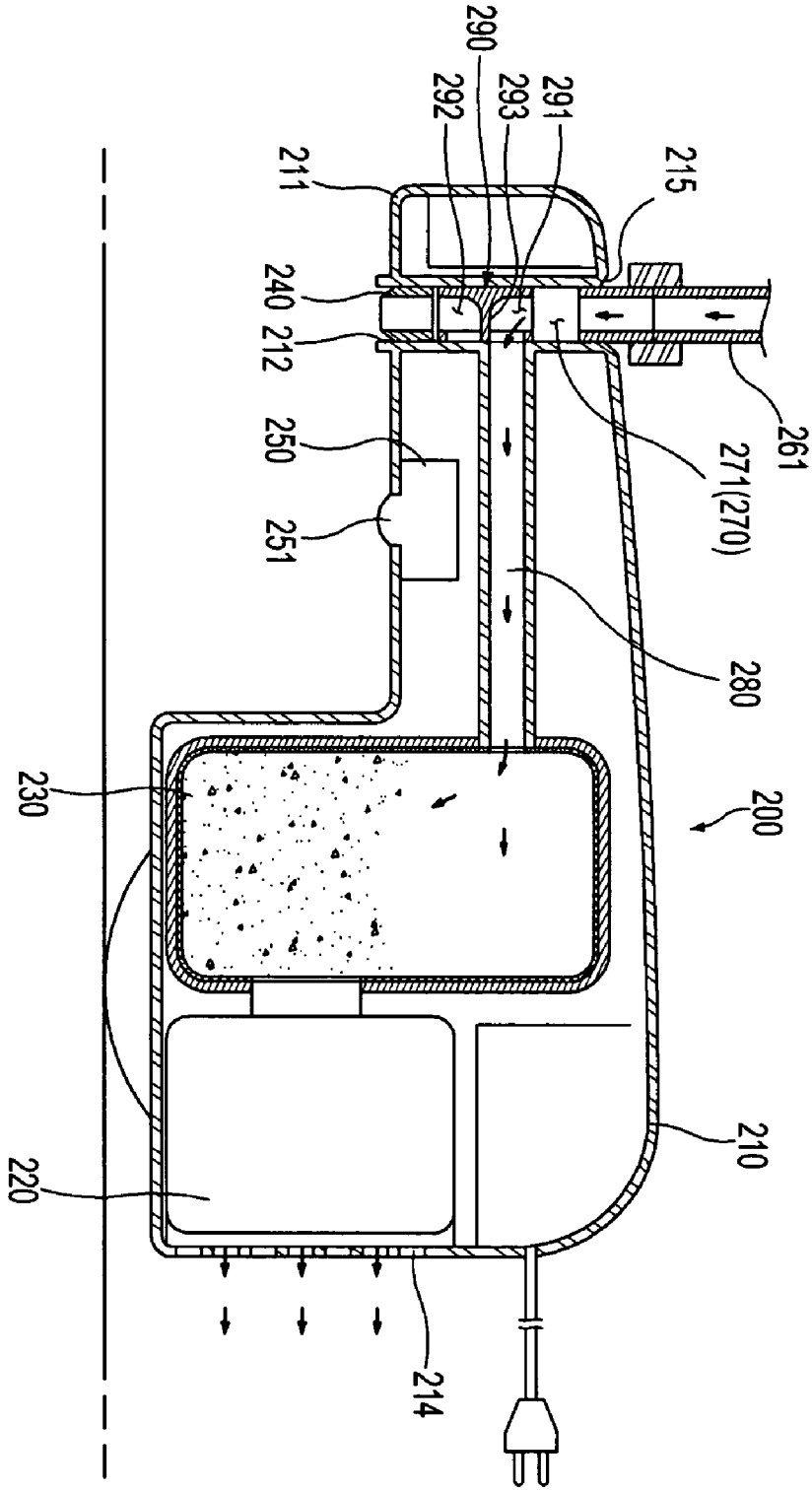
FIG. 6 is a side sectional view illustrating the docking station of FIG. 5.
Figure 7:
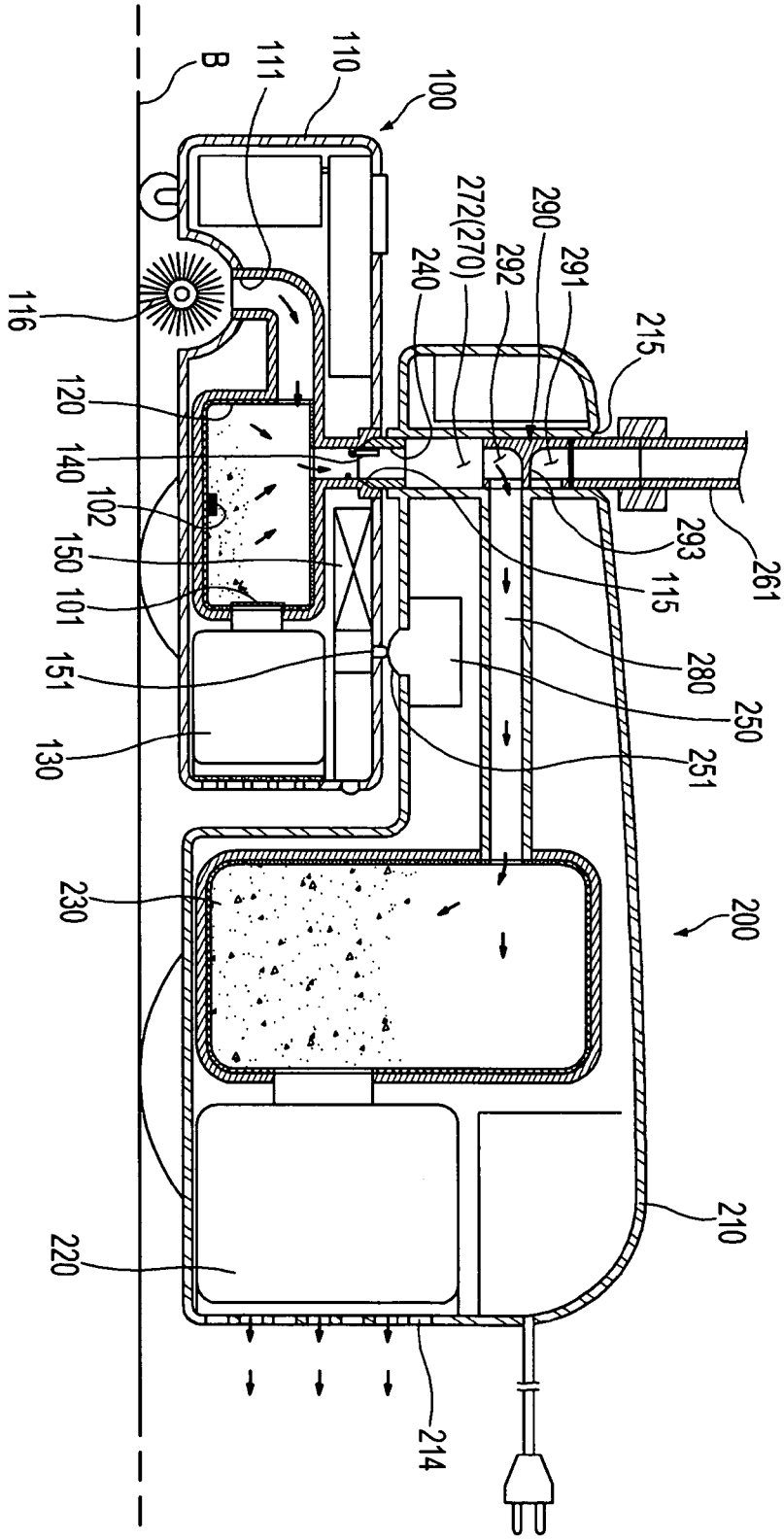
FIG. 7 is a side sectional view of the cleaner system of FIG. 5, illustrating the robot cleaner and docking station coupled to each other.

FIG. 5 is a perspective view schematically illustrating an outer appearance of a cleaner system according to another embodiment of the present invention. FIG. 6 is a side sectional view showing the configuration of a docking station of FIG. 5. FIG. 7 is a side sectional view of the cleaner system of FIG. 5, illustrating the robot cleaner and docking station which are coupled to each other. The second embodiment of the present invention describes an example in which the docking station for the removal of dust is used as a general vacuum cleaner. Hereinafter, the same elements as those of the embodiment shown in FIG. 1 are designated as the same reference numerals, and only characteristic features of the present embodiment will be explained.

As shown in FIGS. 5-7, the docking station 200 of the cleaner system according to another embodiment of the present invention comprises a suction part 260 to suck dust and loose debris from the floor B, and a suction pipe 261 to connect the suction part 260 to the station body 210 so as to transfer a suction force generated by the second blower 220 to the suction part 260.

The suction pipe 261 includes a first suction pipe 261*a* and a second suction pipe 261*b*. A handle 262 is interposed between the first suction pipe 261*a* and the second suction pipe 261*b*. The handle 262 includes a variety of buttons to ensure easy manipulation. The first suction pipe 261*a* is a flexible wrinkled pipe, and includes a first end connected with the station body 210 and a second end connected with the handle 262. The second suction pipe 261*b* includes a first end connected with the handle 262 and a second end connected with the suction part 260. Thus, a user is able to perform manual cleaning to remove dust and loose debris from the floor while moving freely in a standing position.

A suction hole 215 is formed at an upper surface of the protruding portion 211 of the station body 210 such that the suction pipe 261 is connected with the suction hole 215. A first suction channel 270 is defined between the suction hole 215 and the connection port 212. Also, a second suction channel 280 is defined between the first suction channel 270 and the second dust collector 230 to communicate with the first suction channel 270, in order to guide the dust and debris, having passed through the first suction channel 270, into the second dust collector 230. Based on a position where the first suction channel 270 communicates with the second suction channel 280, the first suction channel 270 is divided into a first channel portion 271 in the proximity of the suction hole 215 and a second channel portion 272 in the proximity of the connection port 212.

The first suction channel 270 is provided with a channel switching member 290, which selectively communicates the second suction channel 280 with one of the first and second channel portions 271 and 272. When the channel switching member 290 communicates the first channel portion 271 with the second suction channel 280, a suction force generated by the second blower 220 is applied to the suction part 260 through the suction hole 215, thereby allowing the docking station 200 to be used as a general vacuum cleaner (See FIG. 6). Also, when the dust and debris collected in the robot cleaner 100 needs to be removed, the channel switching member 290 communicates the second channel portion 272 in the proximity of the connection port 212 with the second suction channel 280, thereby allowing the suction force generated by the second blower 220 to be applied to the first dust collector 120 through the connection port 212 and the dust outlet 115. As a result, the dust and debris collected in the first dust collector 120 of the robot cleaner 100 are sucked into the second dust collector 230, to be removed completely from the first dust collector 120 (See FIG. 7, for example).

The channel switching member 290 is mounted to move vertically in the first suction channel 270. The channel switching member 290 is internally defined with a first connection channel 291 to connect the first channel portion 271 to the second suction channel 280 when the channel switching member 290 moves downward, and a second connection channel 292 to connect the second channel portion 272 to the second suction channel 280 when the channel switching member 290 moves upward. A partition 293 is located between the first connection channel 291 and the second connection channel 292 to separate them from each other.

Although not shown, the channel switching member 290 may be moved vertically by use of a drive unit including a motor, rack gear, pinion gear, etc.

It will be appreciated that the above-described configuration of the channel switching member 290 is merely exemplary, and it may be one selected from among a variety of elements including a valve, so long as it can selectively switch the channel.

As apparent from the above description, the present invention provides a cleaner system wherein dust and debris collected in a robot cleaner are discharged out of the robot cleaner through a dust outlet that is formed at the top of the robot cleaner, whereby loss of a suction force generated by a docking station can be prevented. Accordingly, the time and suction force required to remove the dust and debris collected can be reduced while achieving high dust removal efficiency.

Further, according to the present invention, the robot cleaner is connected with the docking station by use of a connector, and therefore, there is no risk of leakage of dust and suction force generated by the docking station when the dust is sucked into the docking station.

Furthermore, the docking station of an embodiment of the present invention is able to be used as a general vacuum cleaner when a suction pipe is added thereto, resulting in an improvement in the convenience of use.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cleaner system comprising:
a robot cleaner comprising:
a robot body having an inlet to receive dust,
a first dust collector mounted in the robot body to collect the dust received, and
a dust outlet formed at a top wall of the robot body to discharge the dust collected in the first dust collector; and
a docking station removing the dust collected in the first dust collector when the docking station is connected with the robot cleaner, the docking station comprising:
a connection port formed at a position thereof corresponding to the dust outlet to receive the dust discharged from the dust outlet,
a station body including a blower and a second dust collector mounted in the station body to suck and collect dust, and a suction hole,
a suction pipe connected with the station body to enable manual cleaning using the docking station, the suction hole communicating with the suction pipe,
a first suction channel defined between the suction hole and the connection port, and
a channel switching member provided in the station body vertically movable between a first position in the first suction channel allowing the suction hole to communicate with the second dust collector and a second position in the first suction channel allowing the connection port to communicate with the second dust collector to selectively apply a force generated by the blower to the connection port or to the suction hole.

2. The cleaner system according to claim 1, further comprising:
a connector mounted in the robot cleaner or the docking station to connect the dust outlet to the connection port when the robot cleaner is coupled with the docking station.

3. The cleaner system according to claim 1, wherein the dust outlet comprises an opening/closing member to close the dust outlet when the robot cleaner performs automatic cleaning.

4. The cleaner system according to claim 1, wherein the robot cleaner further comprises a rechargeable battery, and the docking station comprises a charger to be electrically connected with the rechargeable battery when the robot cleaner is coupled to the docking station, to charge the rechargeable battery.

5. The cleaner system according to claim 1, wherein a second suction channel is defined between the first suction channel and the second dust collector to communicate with the first suction channel.

6. The cleaner system according to claim 5, wherein, the first suction channel is divided into a first channel portion in the proximity of the suction hole and a second channel portion in the proximity of the connection port, depending on a position where the first suction channel communicates with the second suction channel, and
wherein the first suction channel comprises a channel switching member to selectively communicate the second suction channel with one of the first and second channel portions.

7. The cleaner system according to claim 6, wherein the channel switching member is vertically movable in the first suction channel.

8. The cleaner system according to claim 7, wherein the channel switching member comprises a first connection channel to connect the first channel portion to the second suction channel when the channel switching member moves downward, and a second connection channel to connect the second channel portion to the second suction channel when the channel switching member moves upward.

9. The cleaner system according to claim 1, wherein the robot cleaner further comprises a rechargeable battery, and the docking station further comprises a charger to be electrically connected with the rechargeable battery when the robot cleaner is coupled to the docking station, to charge the rechargeable battery.

10. A cleaner system comprising a robot cleaner having a first dust collector, and a docking station to remove dust collected in the first dust collector, wherein the robot cleaner comprises a dust outlet to discharge the dust into the docking station, and wherein the docking station comprises:

a station body having a connection port to receive the dust discharged from the dust outlet, a suction hole to receive dust sucked from the floor into the station body, a second dust collector to collect the dust delivered from the connection port and the suction hole, a blower to generate a suction force required for the suction of dust, a first suction channel defined between the suction hole and the connection port, and a channel switching member provided in the station body vertically movable between a first position in the first suction channel allowing the suction hole to communicate with the second dust collector and a second position in the first suction channel allowing the connection port to communicate with the second dust collector to selectively apply the suction force generated by the blower to the connection port or suction hole.

11. The cleaner system according to claim 10, wherein a second suction channel is defined between the first suction channel and the second dust collector to communicate with the first suction channel, the channel switching member selectively providing communication between the suction hole of the docketing station and the second suction channel and between the connection port receiving dust from the robot cleaner and the second suction channel.

12. The cleaner system according to claim 11, wherein the first suction channel is divided into a first channel portion in the proximity of the suction hole and a second channel portion in the proximity of the connection port depending on a position where the first suction channel communicates with the second suction channel, and the channel switching member selectively communicates the second suction channel with one of the first and second channel portions.

13. A cleaner system, comprising:

a robot cleaner to automatically clean and collect dust, comprising:

an inlet to receive the dust, a first dust collector to collect the dust received via the inlet, a dust outlet positioned on a top portion thereof, to discharge dust therefrom, and a suction part to suction dust; and a docking station to remove the dust from the robot cleaner, comprising:

a station body including a blower, a protruding portion, a connection port corresponding to the dust outlet of the robot cleaner and coupled with the dust outlet via a connector to receive the dust discharged from the dust outlet a suction pipe to connect the suction part of the robot cleaner with the docking station and to receive the dust suctioned by the suction part, to thereby enable a user to perform manual cleaning via the docking station, a suction hole communicating with the suction pipe, a first suction channel defined between the suction hole and the connection port, and a channel switching member provided in the station body vertically movable between a first position in the first suction channel allowing the suction hole to communicate with the second dust collector and a second position in the first suction channel allowing the connection port to communicate with the second dust collector to selectively apply a force generated by the blower to the connection port or to the suction hole, and a second dust collector to collect the dust received via the connection port, wherein the robot cleaner is received under the protruding portion of the docking station and coupled with the docking station at the suction part to perform a dust removal operation.

14. The cleaner system of claim 13, wherein the docking station further comprises:

a second suction channel formed between the first suction channel and the second dust collector, wherein the dust collected by the suction part travels through the suction pipe into the first suction channel, and into the second dust collector via the second suction channel, wherein the suction hole is formed through the protruding portion and corresponding to the connection port, to receive the suction pipe therein.

15. The cleaner system of claim 13, wherein when the dust collected by the first dust collector of the robot cleaner while automatically cleaning and collecting dust, exceeds a predetermined level, the robot cleaner returns to the docking station for removal of the dust collected, and the docking station performs the dust removal operation.

16. The cleaner system of claim 15, wherein the robot cleaner further comprises a dust quantity sensor to sense a quantity of the dust collected in the first dust collector and to determine whether the dust collected exceeds the predetermined level.

* * * * *